US007462064B2

(12) United States Patent
Vasarhelyi

(10) Patent No.: US 7,462,064 B2
(45) Date of Patent: Dec. 9, 2008

(54) STRAIN RELIEF DEVICES

(75) Inventor: John M Vasarhelyi, Cary, NC (US)

(73) Assignee: Pentair Water Pool and Spa, Inc., Sanford, NC (US)

( * ) Notice: Subject to any disclaimer, the term of this patent is extended or adjusted under 35 U.S.C. 154(b) by 0 days.

(21) Appl. No.: 11/542,451

(22) Filed: Oct. 3, 2006

(65) Prior Publication Data

US 2008/0207043 A1 Aug. 28, 2008

Related U.S. Application Data

(60) Provisional application No. 60/817,059, filed on Jun. 28, 2006.

(51) Int. Cl.
*H01R 13/58* (2006.01)

(52) U.S. Cl. ..... 439/469

(58) Field of Classification Search ..... 439/469, 439/466, 801, 810, 814, 815, 468, 473, 472, 439/470, 459, 460, 465, 447
See application file for complete search history.

(56) References Cited

U.S. PATENT DOCUMENTS 2,659,765 A 11/1953 Dunn
2,667,368 A 1/1954 Ferguson
3,424,856 A 1/1969 Coldren
4,080,035 A * 3/1978 Clark et al. ..... 439/471
4,178,057 A 12/1979 McCormick
4,244,638 A * 1/1981 Little et al. ..... 439/471
4,623,753 A 11/1986 Feldman et al.
5,382,752 A 1/1995 Reyhan et al.
5,541,363 A 7/1996 Weise et al.
5,675,124 A * 10/1997 Stough et al. ..... 174/656
5,686,700 A 11/1997 Carpinella
6,123,573 A * 9/2000 Savicki, Jr. ..... 439/469
6,421,494 B1 * 7/2002 Battey et al. ..... 385/136

* cited by examiner

*Primary Examiner*—Edwin A. León
(74) *Attorney, Agent, or Firm*—Greenberg Taurig, LLP

(57) ABSTRACT

A strain relief device can include at least one mounting tab including a first mounting surface facing a first mounting surface direction and a second mounting surface facing a second mounting surface direction opposite the first mounting surface direction. The strain relief device can further include first and second clamping surfaces that face in diverging directions and extend along a substantially V-shaped profile. Apparatus are also provided that include a first strain relief device and a second strain relief device configured to be selectively mounted with respect to the first strain relief device in a first orientation to provide a first clamping area and a second orientation to provide a second clamping area.

6 Claims, 8 Drawing Sheets

STRAIN RELIEF DEVICES

CROSS-REFERENCE TO RELATED APPLICATION

The present invention claims the benefit of U.S. Provisional Application No. 60/817,059 filed Jun. 28, 2006, the entire disclosure which is herein incorporated by reference.

FIELD OF THE INVENTION

The present invention relates to strain relief devices and more particularly to strain relief devices for wires, cables and the like.

BACKGROUND OF THE INVENTION

Electrical wire connections are know to be housed within an electrical junction box to prevent inadvertent contact with an individual or other object located adjacent the electrical connections. Such junction boxes are frequently designed to reduce the possibility of fire hazards resulting from improper wiring techniques and/or subsequent damage to the wiring connections. In many applications, there is a desire to counter the force from an exterior pull of wires entering the junction box. Left unchecked, such an exterior pull can result in movement or removal of the wires within the junction box that can damage the electrical connections within the junction box. In order to address this problem, it is known to provide the junction box with a conventional strain relief device configured inhibit the ends of the wires from being pulled or otherwise moved within the junction box. There is a need to provide strain relief devices that are inexpensive and easy to install for use with a wide range of support structures, such as junction boxes.

SUMMARY OF THE INVENTION

It is an aspect of the present invention to obviate problems and shortcomings of conventional strain relief devices.

In accordance with one aspect, an integral one piece strain relief device is adapted to be mounted to a support structure. The strain relief device comprises at least one mounting tab including a first mounting surface facing a first mounting surface direction and a second mounting surface facing a second mounting surface direction opposite the first mounting surface direction. The strain relief device further includes a first clamping surface attached to the at least one mounting tab and facing in a first clamping surface direction and a second clamping surface attached to the at least one mounting tab and facing in a second clamping surface direction. The first and second clamping surface directions diverge from one another and the first and second clamping surfaces extend along a substantially V-shaped profile.

In accordance with another aspect, an apparatus comprises a first strain relief device with a first clamping surface and a second strain relief device with a first clamping surface and a second clamping surface. The second strain relief device is configured to be selectively mounted with respect to the first strain relief device in a first orientation to provide a first clamping area and a second orientation to provide a second clamping area with a different size than the first clamping area. The first clamping surfaces of the first and second strain relief devices are configured to cooperate to define the first clamping area in the first orientation. The first clamping surface of the first strain relief device and the second clamping surface of the second strain relief device are configured to cooperate to define the second clamping area in the second orientation.

In accordance with still another aspect, an apparatus comprises a first strain relief device comprising a first clamping surface and a second strain relief device comprising a first clamping surface facing a first clamping surface direction and a second clamping surface facing a second clamping surface direction. The first and second clamping surface directions diverge from one another and the first and second clamping surfaces of the second strain relief device extend along a substantially V-shaped profile. The second strain relief device is configured to be selectively mounted with respect to the first strain relief device in a first orientation to provide a first clamping area and a second orientation to provide a second clamping area. The first clamping surfaces of the first and second strain relief devices are configured to face one another to define the first clamping area in the first orientation. The first clamping surface of the first strain relief device and the second clamping surface of the second strain relief device are configured to face one another to define the second clamping area in the second orientation.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
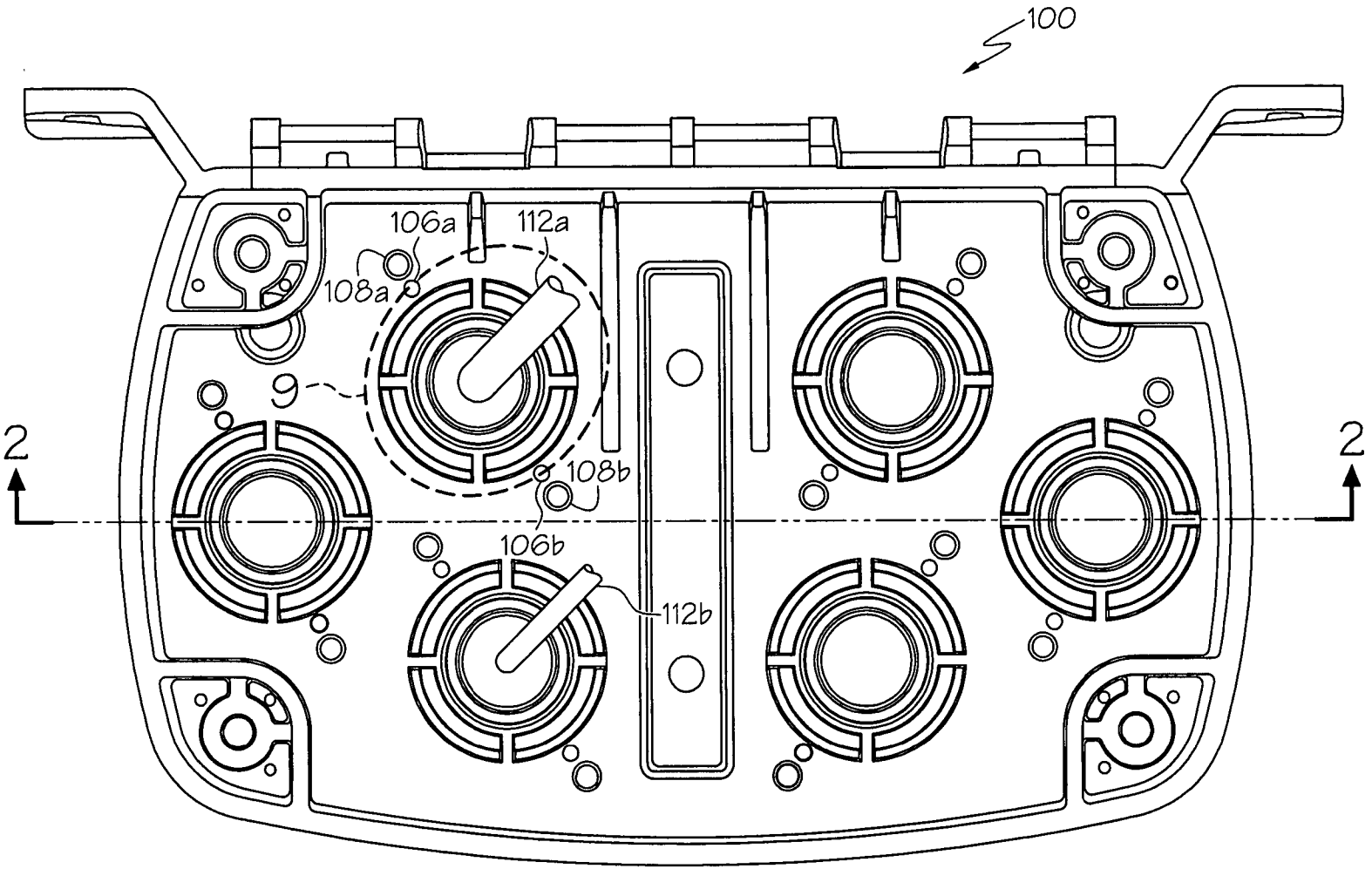
FIG. 1 is a top view of an example junction box that may be used with example strain relief devices.

Certain terminology is used herein for convenience only and is not to be taken as a limitation on the present invention. Further, in the drawings, the same reference numerals are employed for designating the same elements.

Figure 2:
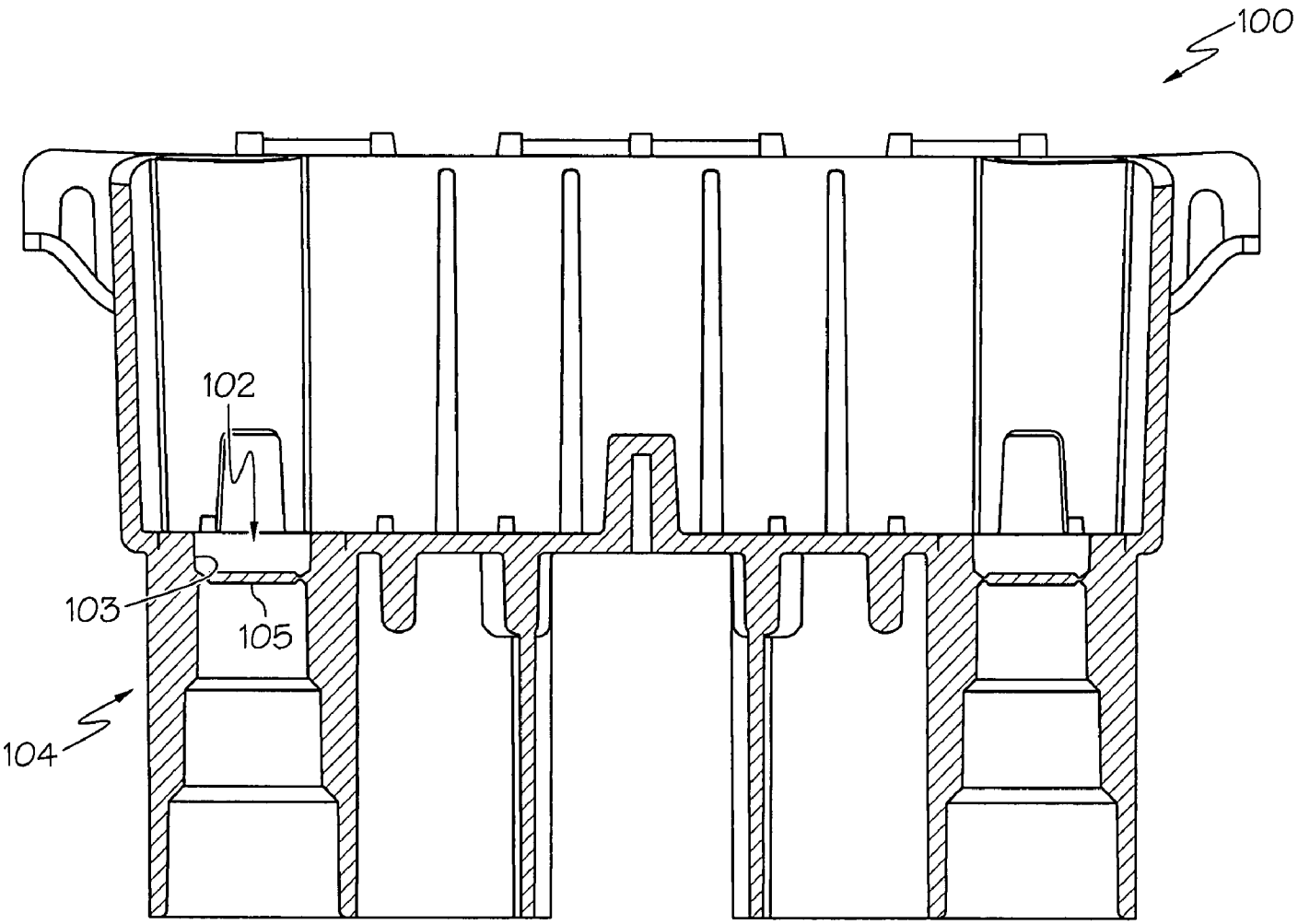
FIG. 2 is a sectional view of the junction box along line 2-2 of FIG. 1.

Strain relief devices herein may used in a wide variety of applications to provide strain relief for elongated elements such as cables, wires, ropes, or the like. In one example, the strain relief devices may provide strain relief for an elongated element extending with respect to a support structure. Support structures can comprise a wall, panel, electrical board, partition, electrical box, junction box or the like. For instance, the strain relief devices may be used with the junction box 100 shown in FIGS. 1 and 2 although other support structures (e.g., junction boxes) may be used in further examples. Although not shown, the junction box may include a cover to enclose a space for electrical connections within the box.

As further shown, the strain relief devices may be used with openings 102 including a female socket portion 103 associated with a coupling 104 configured to introduce portions of a cable, wire or other electrical component therethrough. It will be appreciated that apparatus and strain relief devices herein may be used with a wide variety of other junction boxes or other types of support structures or couplings.

One example strain relief device 20 is shown in FIGS. 3-8. The strain relief device can comprise an integral one piece construction such as an injection molded piece. In further examples, the integral one piece construction may be formed from separate pieces that are glued, sonic welded or otherwise integrally attached to one another. In still further examples, it is contemplated that the strain relief device may comprise separate components that are connected to one another. The strain relief device can comprise a polymeric material although other materials such as metals (e.g., stainless steel), woods, resins, composites or the like may be used in further examples.

In example embodiments, the strain relief device 20 can comprise at least one mounting tab. The at least one mounting tab, if provided, can comprise a single or a plurality of mounting tabs. In the illustrated example, the at least one mounting tab comprises a first mounting tab 22*a* and a second mounting tab 22*b* although three or more mounting tabs may be incorporated in further examples. The first mounting tab 22*a* includes a first mounting surface 24*a* facing a first mounting surface direction 26 and a second mounting surface 28*a* facing a second mounting direction 30 opposite the first mounting direction 26. Likewise, the second mounting tab 22*b* includes a first mounting surface 24*b* facing the first mounting surface direction 26 and a second mounting surface 28*b* facing the second mounting direction 30 opposite the first mounting direction 26. As shown, the directions 26, 30 are located approximately 180° with respect to one another although it is contemplated that the directions may be considered to be oriented such that the directions extend opposite to one another at other nonparallel positions. For example, any orientation where the directions are nonparallel to one another can be considered to extend opposite with respect to one another as the directions include oppositely extending directional components that are oriented at approximately 180° with respect to one another.

Figure 3:
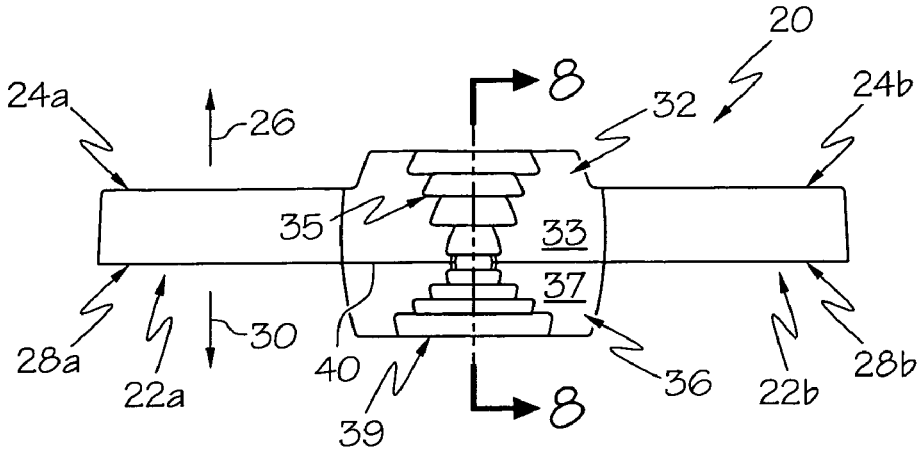
FIG. 3 is a front view of a strain relief device in accordance with one example of the present invention.
Figure 4:
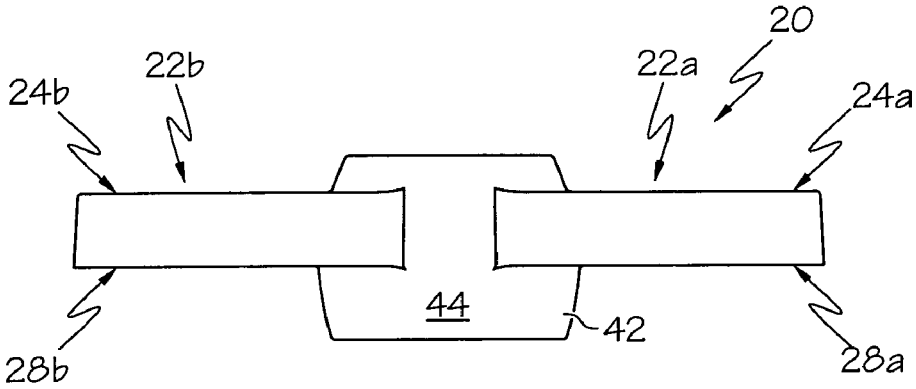
FIG. 4 is a rear view of the strain relief device of FIG. 3.
Figure 5:
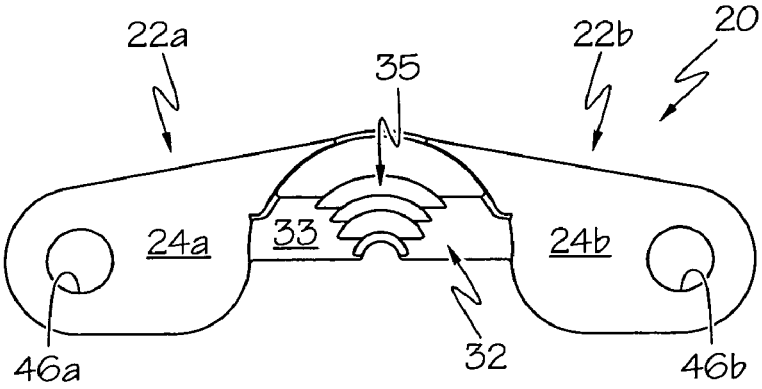
FIG. 5 is a top view of the strain relief device of FIG. 3.

The first mounting surface and/or the second mounting surface can extend along respective planar or nonplanar surfaces. For example, as shown in FIGS. 3-6, the first mounting surface can include coplanar first mounting surface portions 24*a*, 24*b* and the second mounting surface can include coplanar second mounting surface portions 28*a*, 28*b*. In still further examples, the first mounting surface and the second mounting surface can be parallel to one another although nonparallel orientations are also contemplated. For example, as shown in FIGS. 3 and 4, the first coplanar mounting surface portions 24*a*, 24*b* are parallel with respect to the second coplanar mounting surface portions 28*a*, 28*b*.

The at least one mounting tab can also include a mounting aperture configured to facilitate mounting of the strain relief device with respect to a support structure. For example, as shown, the first mounting tab 22*a* can include a first mounting aperture 46*a* and the second mounting tab 22*b* can include a second mounting aperture 46*b* spaced a distance from the first mounting aperture 46*a*. As shown, the first mounting aperture 46*a* extends through the first mounting surface portion 24*a* and the second mounting surface portion 28*a* of the first mounting tab 22*a* while the second mounting aperture 46*b* extends through the first mounting surface portion 24*b* and the second mounting surface portion 28*b* of the second mounting tab 22*b*.

Figure 6:
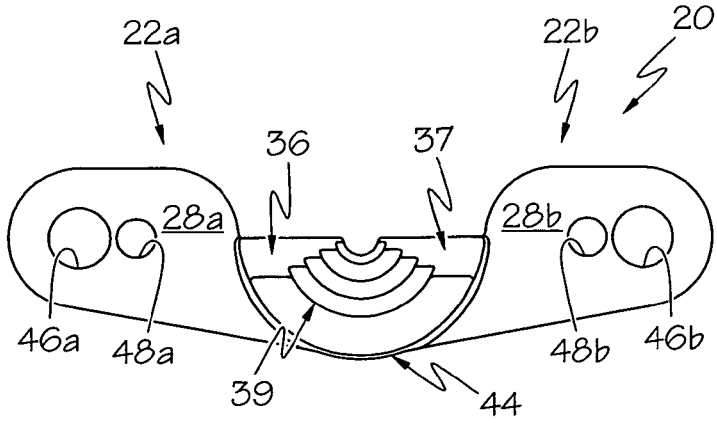
FIG. 6 is a bottom view of the strain relief device of FIG. 3.
Figure 7:
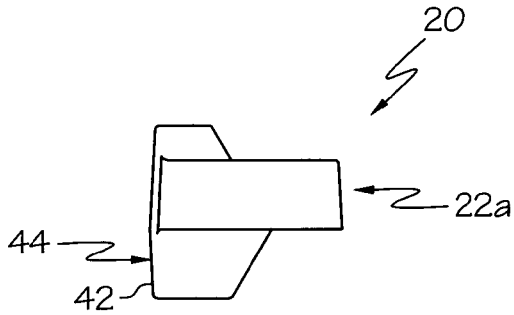
FIG. 7 is a left side view of the strain relief device of FIG. 3.
Figure 8:
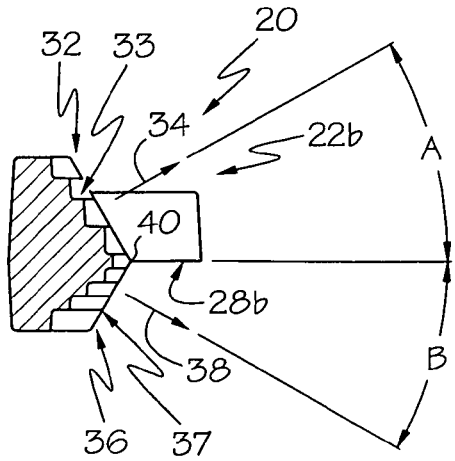
FIG. 8 is a sectional view of the strain relief device along line 8-8 of FIG. 3.

In addition, the strain relief device can include at least one optional orienting structure configured to cooperate with a support structure to achieve a predetermined orientation between the strain relief device and the support structure. The predetermined orientation can comprise an angular orientation with respect to the support structure and/or a side orientation such that only one of the first or second mounting surfaces may be properly positioned adjacent the support structure. Although a single orienting structure may be provided, further examples may include a two or more orienting structures. As shown in FIG. 6, for instance, the second mounting surface portions 28*a*, 28*b* can each include a corresponding orienting aperture 48*a*, 48*b* configured to receive respective orienting pins 106*a*, 106*b* of the support structure (see FIG. 1). In further examples, the support structure may include orienting apertures while the strain relief device includes orienting pins configured to be received by the orienting apertures. It is further contemplated that alternative orienting structure may be incorporated in further examples.

As shown in FIGS. 3, 5, 6 and 8, the strain relief device can include a first clamping surface 32 and facing a first clamping surface direction 34 and a second clamping surface 36 facing a second clamping surface direction 38. As shown, in FIG. 8, the first and second clamping surface directions 34, 38 can diverge from one another at a wide variety of angles depending on the application. As shown, in one example, the angle A and B can each be approximately the same angle from the a planar surface (e.g., of the second mounting surface portions 28*a*, 28*b*) although it is contemplated that different angles may be employed in further examples. Moreover, each angle A and B is shown to be approximately 30° from the planar surface although the strain relief device may be constructed with other angles in further examples. Moreover, the first and second clamping surfaces 32, 36 can also extend along a substantially V-shaped profile. As further shown in FIG. 8, the clamping surfaces 32, 36 can extend along substantially the entire V-shaped profile such that the clamping surfaces 32, 36 form a substantially V-shaped cross section.

The clamping surfaces 32, 36 can comprise a wide variety of shapes configured to engage an elongated element. For instance, one or both of the clamping surfaces can include a portion extending along a corresponding clamping plane. For example, as shown, the first clamping surface 32 can include a portion extending along a first clamping plane 33. In addition, or alternatively, the second clamping surface 36 can include a portion extending along a second clamping plane 37. As shown, the first and second clamping planes 33, 37 can intersect one another along an intersection line 40 that is disposed along the plane of the second mounting surface portions 28*a*, 28*b* of the mounting tabs 22*a*, 22*b*. Providing the intersection line at such a location can help provide an apparatus with different clamping area sizes depending on the orientation of a plurality of strain relief devices mounted with respect to one another. Although not shown, further examples may include an intersection line located such that the clamping area size of the apparatus is the same regardless of the orientation of the strain relief devices with respect to one another.

One or more of the clamping surfaces can include a cleat structure configured to facilitate gripping of an elongated element in use. For example, the first clamping surface 32 can include a first cleat structure 35. In addition or alternatively, the second clamping surface 36 can include a second cleat structure 39. The cleat structures, if provided, can comprise a wide range of shapes and sizes. For example, the cleat structures can comprise protrusions, a knurled surface, teeth or the like. As shown in the illustrated example, the cleat structures can comprise a plurality of concentric arcuate ribs although other structures may be used.

As shown, the first and second clamping surface 32, 36 can be attached to the at least one mounting tab 22*a*, 22*b* by way of a central hub portion. The central hub portion can include a male socket structure 42 including an arcuate surface 44 configured to the shape of the female socket portion 103 associated with the coupling 104 although other configurations may be used in further examples.

Figure 9:
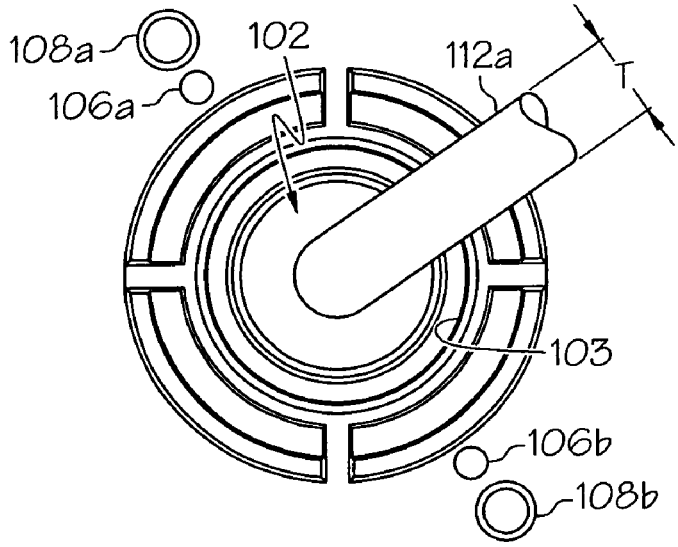
FIG. 9 is an enlarged view of portions of the junction box from view 9 of FIG. 1.

Construction of an apparatus in a first orientation 50 to provide a first clamping area 52 and construction of an apparatus in a second orientation 60 to provide a second clamping area 62 are illustrated and described with respect to FIGS. 9-13. The illustrated and described construction is shown for use with the illustrated junction box 100 although it is contemplated that a similar procedure may be used to create similar apparatus types for other junction box designs and/or other support structures. As shown in the example of FIG. 9, a coupling is first selected for receiving an elongated element 112*a*, such as a cable having a thickness "T". Prior to inserting the elongated element 112*a*, a corresponding coupling cover 105 (see FIG. 2) can be removed such that the end of the elongated element 112*a* may be easily inserted through the opening 102 and into the interior area of the junction box.

Figure 10:
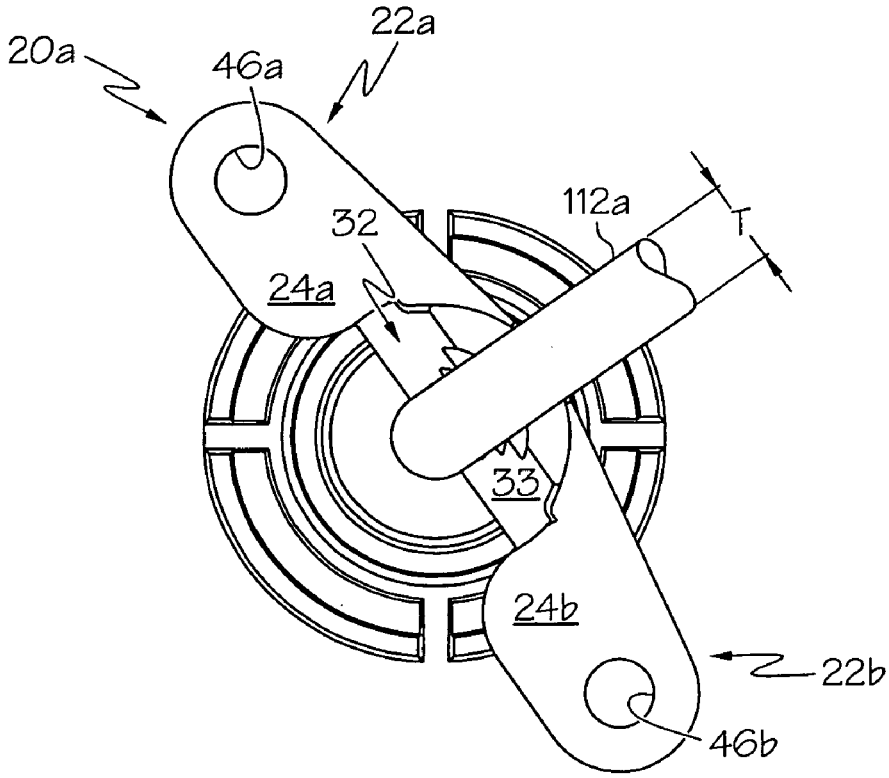
FIG. 10 depicts a first strain relief device being oriented with respect to portions of the junction box shown in FIG. 9.

As shown in FIG. 10, construction of the apparatus in the first orientation 50 to provide the first clamping area 52 or construction of the apparatus in the second orientation 60 to provide the second clamping area 62 can begin by orienting a first strain relief device 20*a* with respect to the support structure. As shown, the support structure includes a pair of orienting pins 106*a*, 106*b* that aligned with a center of the opening 102 and located at substantially equal distances from the center of the opening 102. The orienting pins 106*a*, 106*b* help angularly orient the first strain relief device 20*a* with respect to the opening 106 and also only permit orientation of the second mounting surface portions 28*a*, 28*b* against the mounting structure adjacent the opening 102. Indeed, only the second mounting surface portions 28*a*, 28*b* include the orienting apertures 48*a*, 48*b*. Thus, the first strain relief device 20*a* can be mounted in the orientation shown in FIG. 10 but cannot be oriented with the first mounting surface portions 24*a*, 24*b* facing the support structure since the first mounting surface portions 24*a*, 24*b* lack the orienting apertures and would therefore interfere with the orienting pins. Although not shown, the first strain relief device 20*a* could alternatively be mounted at a position rotated at 180° about a central axis of the opening 102 from the position shown in FIG. 10. Rotating the first strain relief device 180° can allow the elongated element 112*a* to be oriented in the opposite direction.

The apparatus in the first orientation 50 or the apparatus in the second orientation 60 can be assembled from the first strain relief device 20*a* shown in FIG. 10. The ability to configure the apparatus in the first or second orientation 50, 60 can allow an installer to accommodate elongated elements (e.g., cable) having different thicknesses. In the illustrated example, the apparatus in the first orientation 50 is configured to accommodate elongated elements 112*a* having a relatively large thickness "T" while constructing an apparatus in the second orientation 60 is configured to accommodate elongated elements 112*b* having a relatively smaller thickness "t".

Figure 11:
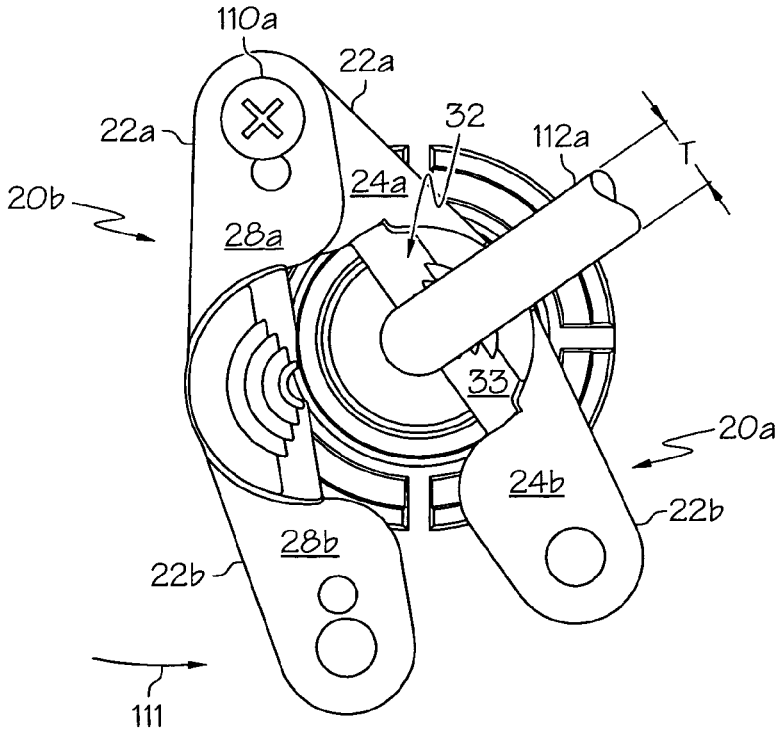
FIG. 11 depicts a second strain relief device being mounted with respect to the first strain relief device of FIG. 10 in a first orientation prior to clamping.
Figure 12:
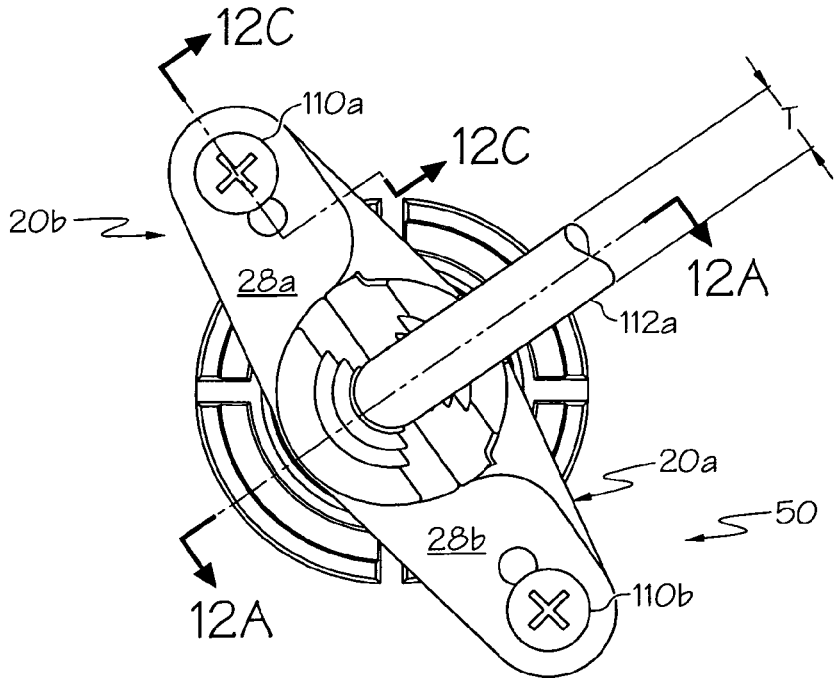
FIG. 12 depicts the second strain relief device of FIG. 11 being further mounted with respect to the first strain relief device to clamp an elongated element in a first clamping area.

FIGS. 11 and 12 depict further procedures for constructing an apparatus in the first orientation 50 to accommodate the elongated element 112*a* having the relatively large thickness "T". As shown, a second strain relief device 20*b* can be provided for use with the first strain relief device 20*a*. As further illustrated, the second strain relief device 20*b* is identical to the first strain relief device 20*a* although it is contemplated that the second strain relief device may have different characteristics and/or may mount differently with respect to the first strain relief device in accordance with further aspects of the present invention. As shown in the example of FIG. 11, the second strain relief device 20*b* can be oriented such that the first mounting surface portions 24*a* of each first mounting tab 22*a* face one another with each first mounting aperture 46*a* being aligned. Next, a fastener such as a screw 110*a* is placed through the aligned apertures 46*a* and screwed into the first mounting aperture 108*a* of the support structure. Next, the second strain relief device 20*b* may be pivoted about the screw 110*a* along pivot direction 111 to clamp the elongated element 112*a* with the apparatus in the first orientation 50. Once appropriately positioned with the second mounting apertures 46*b* aligned, a second fastener, such as a screw 110*b* is placed through the aligned apertures 46*b* and screwed into the second mounting aperture 108*b* in the support structure. Once the screws 110*a*, 110*b* are tightened, the elongated element 112*a* is clamped by the apparatus in the second orientation 50. Although not shown, it is contemplated, that the second strain relief device 20*b* may be initially placed over the first strain relief device 20*a* with the apertures 46*a*, 46*b* simultaneously aligned to receive each screw 110*a*, 110*b* at the same time to clamp the elongated element.

Figure 12A:
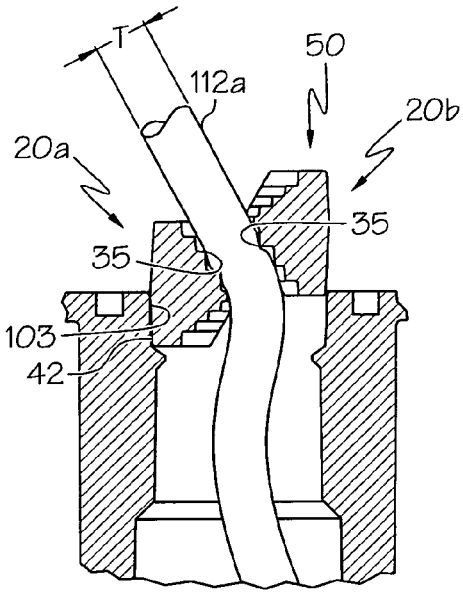
FIG. 12A is a partial sectional view along line 12A-12A of FIG. 12.
Figure 12B:
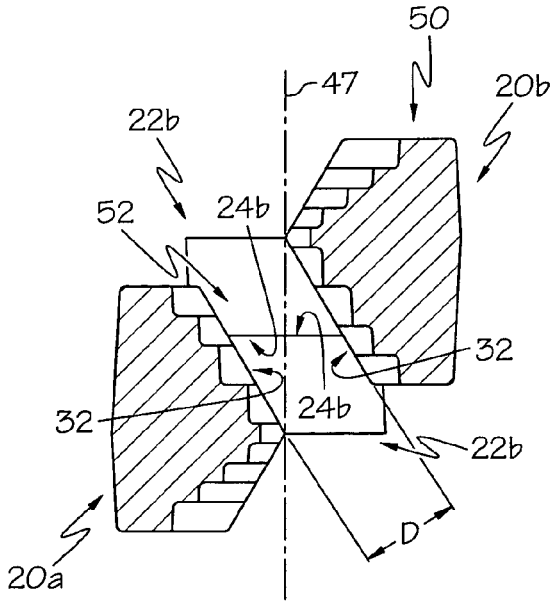
FIG. 12B shows enlarged portions of the partial sectional view of FIG. 12A without the elongated element.
Figure 12C:
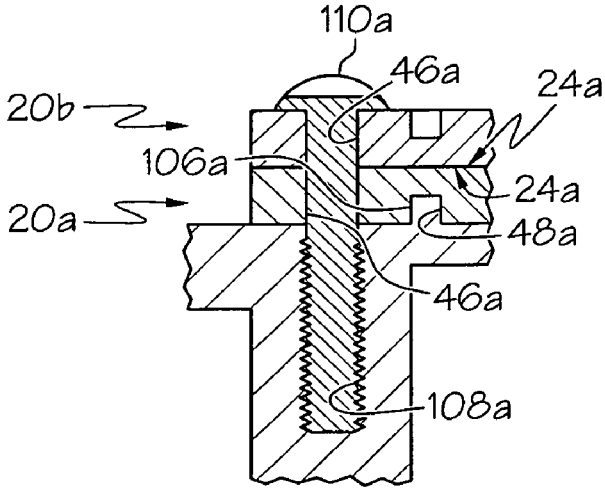
FIG. 12C shows a partial sectional view along line 12C-12C of FIG. 12.

Once clamped, as shown in FIG. 12C, the first orientation pin 106*a* is received in the first orienting aperture 48*a* of the first strain relief device 20*a* as shown in FIG. 12C. FIG. 12C also shows the screw 110*a* extending through the first mounting apertures 46*a* of the first and second strain relief devices 20*a*, 20*b* and being threaded into the mounting aperture 108*a* of the support structure. It will be understood that a similar arrangement is found on the opposite side of the apparatus associated with the second screw 110*b*, the second orientation pin 106*b* and the second orienting aperture 48*b*.

FIG. 12A is a partial sectional view along line 12A-12A of FIG. 12. As shown, the male socket structure 42 of the first strain relief device 20*a* is partially received within the female socket portion 103. A portion of the elongated element 112*a* is also clamped within the first clamping area 52. The cleats 35 of the first clamping surface 32 of each strain relief device 20*a*, 20*b* can bite on an outer surface of the elongated element 112*a* to counter an exterior pulling of the elongated element 112*a*. FIG. 12B shows enlarged portions of the partial sectional view of FIG. 12A without the elongated element. As shown, the V-shaped profile of the clamping surfaces of each strain relief device have an apex that extends along a vertical plane 47 that also extends through the central axis of the mounting apertures 46*a*, 46*b* of the strain relief devices. As further shown in FIG. 12B, the geometry of the strain relief devices provide first clamping surfaces 32 that face one another and include first clamping planes 33 that can be parallel with respect to one another and spaced a distance "D" from one another. It is contemplated that the apparatus can be constructed with various distances "D" depending on the application.

Figure 13A:
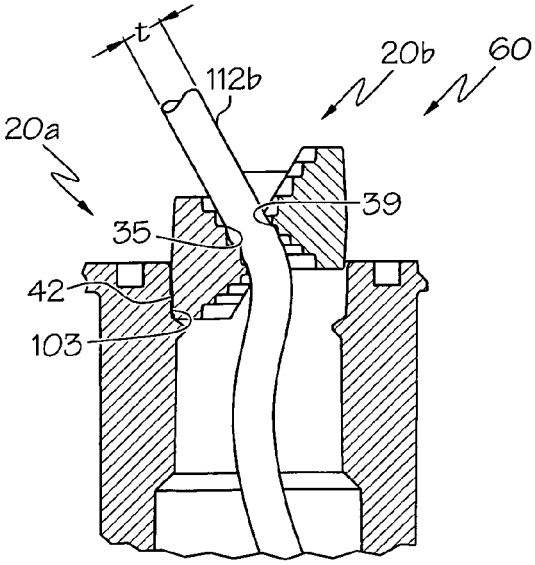
FIG. 13A is a partial sectional view along line 13A-13A of FIG. 13.
Figure 13B:
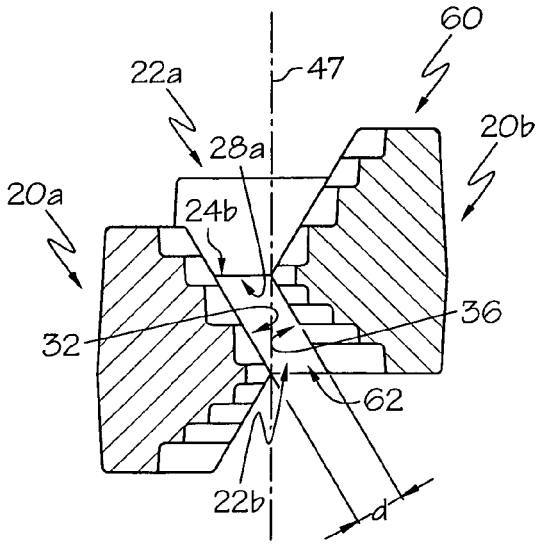
FIG. 13B shows enlarged portions of the partial sectional view of FIG. 12A without the elongated element.
Figure 13:
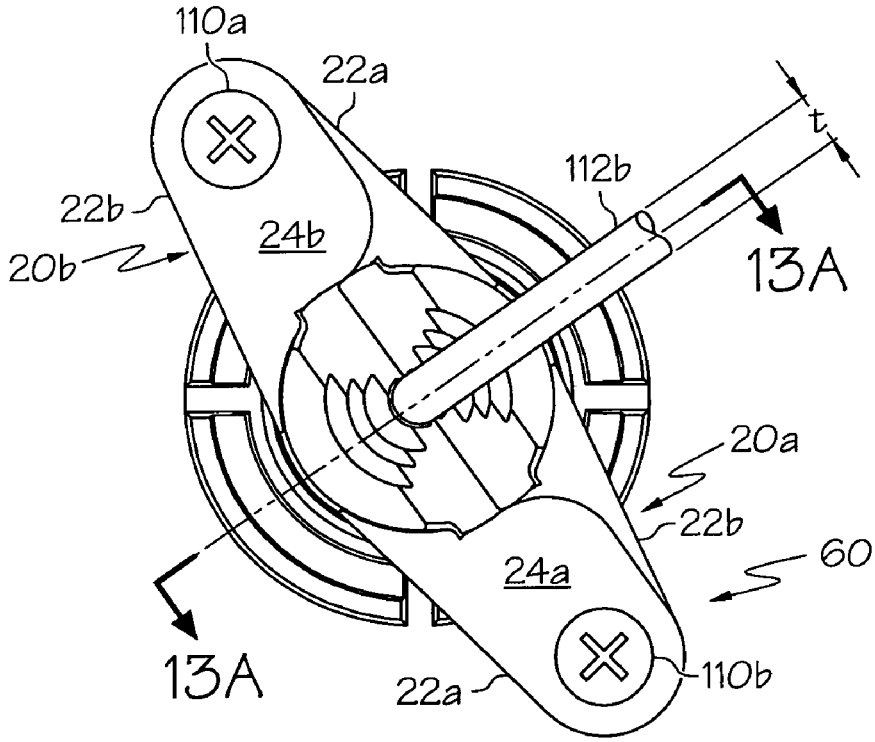
FIG. 13 depicts the second strain relief device being mounted with respect to the first strain relief device of FIG. 10 in the second orientation to clamp another elongated element in a second clamping area.

FIG. 13 depicts an apparatus constructed in the second orientation 60 to accommodate an elongated element 112*b* having a relatively smaller thickness "t". As shown in the example of FIG. 13, the second strain relief device 20*b* can be oriented such that the first mounting surface portion 24*a* of the first strain relief device 20*a* faces the second mounting portion 28*b* of the second strain relief device 20*b*. At the same time, the first mounting surface portion 24*b* of the first strain relief device 20*a* faces the second mounting portion 28*a* of the second strain relief device 20*b*. In this position, the first mounting aperture 46*a* of the first mounting tab 22*a* of the first strain relief device 20*a* is aligned with the second mounting aperture 46*b* of the second mounting tab 22*b* of the second strain relief device 20*b*. Likewise, the second mounting aperture 46*b* of the second mounting tab 22*b* of the first strain relief device 20*a* is aligned with the first mounting aperture 46*a* of the first mounting tab 22*a* of the second strain relief device 20*b*.

To achieve the apparatus in the second orientation 60 shown in FIG. 13, the first strain relief device 20*a* can be positioned as discussed with respect to FIG. 10 above. Next, one or both sets of mounting apertures may be aligned and attached with fasteners, such as screws 110*a*, 110*b* as shown in FIG. 13 to clamp the elongated element 112*b* within the clamping area 62 (see FIG. 13B).

FIG. 13A is a partial sectional view along line 13A-13A of FIG. 13. As shown, the male socket structure 42 of the first strain relief device 20*a* is partially received within the female socket portion 103. A portion of the elongated element 112*b* is also clamped within the second clamping area 62. The cleats 35 of the first clamping surface 32 of the first strain relief device 20*a* and cleats 39 of the second clamping surface 36 of the second strain relief device 20*b* can bite on an outer surface of the elongated element 112*b* to counter an exterior pulling of the elongated element. FIG. 13B shows enlarged portions of the partial sectional view of FIG. 13A without the elongated element. As shown, the V-shaped profile of the clamping surfaces of each strain relief device have an apex that extends along a vertical plane 47 that also extends through the central axis of the mounting apertures 46*a*, 46*b* of the strain relief devices. As further shown in FIG. 13B, the geometry of the strain relief devices provide an orientation with the first clamping surface 32 of the first strain relief device 20*a* facing the second clamping surface 36 of the second strain relief device 20*b*. As further shown, the first clamping plane 33 of the first strain relief device 20*a* is parallel to the second clamping plane 37 of the second strain relief device 20*b* and spaced a distance "d" from one another. It is contemplated that the apparatus can be constructed with various distances "d" depending on the application.

From the above description of the invention, those skilled in the art will perceive improvements, changes and modifications. Such improvements, changes and modifications within the skill of the art are intended to be covered by the appended claims.

What is claimed:

1. An integral one piece strain relief device adapted to be mounted to a support structure and adapted to provide strain relief for conductors, the strain relief device comprising:

at least one mounting tab including a first mounting surface facing a first mounting surface direction and a second mounting surface facing a second mounting surface direction opposite the first mounting surface direction;

a first clamping surface attached to the at least one mounting tab and facing in a first clamping surface direction; and a second clamping surface attached to the at least one mounting tab and facing in a second clamping surface direction, wherein the first and second clamping surface directions diverge from one another and the first and second clamping surfaces extend along a substantially V-shaped profile;

wherein the strain relief device can be rotated between a first orientation and a second orientation with respect to the support structure in order to accommodate conductors having different thicknesses.

2. The strain relief device of claim 1, wherein the first clamping surface and the second clamping surface each include a cleat structure.

3. The strain relief device of claim 1, wherein the first clamping surface includes a portion extending along a first clamping plane and the second clamping surface includes a portion extending along a second clamping plane.

4. The strain relief device of claim 3, wherein the first and second clamping planes intersect one another along an intersection line disposed along the second mounting surface.

5. The strain relief device of claim 1, wherein the at least one mounting tab comprises a first mounting tab including a first mounting aperture and a second mounting tab including a second mounting aperture spaced a distance from the first mounting aperture, wherein the mounting apertures each extend through the first and second mounting surfaces and are configured to facilitate mounting of the strain relief device with respect to a support structure.

6. The strain relief device of claim 5, wherein the at least one mounting tab includes at least one orienting aperture configured to cooperate with a support structure to achieve a predetermined orientation between the strain relief device and a support structure.

* * * * *